US009892685B2

(12) United States Patent
Wu

(10) Patent No.: US 9,892,685 B2
(45) Date of Patent: Feb. 13, 2018

(54) PIXEL COMPENSATION CIRCUIT, METHOD AND FLAT DISPLAY DEVICE

(71) Applicant: Shenzhen China Star Optoelectronics Technology Co., Ltd., Shenzhen, Guangdong (CN)

(72) Inventor: Xiaoling Wu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 148 days.

(21) Appl. No.: 15/023,405

(22) PCT Filed: Feb. 26, 2016

(86) PCT No.: PCT/CN2016/074633

§ 371 (c)(1),
(2) Date: Mar. 21, 2016

(87) PCT Pub. No.: WO2017/128474

PCT Pub. Date: Aug. 3, 2017

(65) Prior Publication Data

US 2017/0330506 A1 Nov. 16, 2017

(30) Foreign Application Priority Data

Jan. 29, 2016 (CN) ..... 2016 1 0064252

(51) Int. Cl.
*G09G 3/325* (2016.01)
*G09G 3/20* (2006.01)
*G09G 3/00* (2006.01)

(52) U.S. Cl.
CPC ..... *G09G 3/325* (2013.01); *G09G 3/007* (2013.01); *G09G 3/2092* (2013.01); *G09G 2320/0233* (2013.01)

(58) Field of Classification Search
CPC ..... G09G 3/3266; G09G 2300/0819; G09G 2300/0852; G09G 2300/0866
See application file for complete search history.

(56) References Cited

U.S. PATENT DOCUMENTS 9,208,725 B2 12/2015 Guo et al.
2005/0243588 A1* 11/2005 Kubota ..... G09G 3/2011 365/63

(Continued)

FOREIGN PATENT DOCUMENTS

CN I02956201 A 3/2013
CN 104599635 A 5/2015

*Primary Examiner* — Shaheda Abdin
(74) *Attorney, Agent, or Firm* — Andrew C. Cheng

(57) ABSTRACT

Pixel compensation circuit, method and flat display device. The circuit includes a control terminal of a first controllable switch connected with a first scanning line, first terminal connected with data line; second terminal connected with control terminal of the driving switch through a storage capacitor, a first terminal of the driving switch connected with a voltage terminal; a control terminal of the second controllable switch connected with a second scanning line, a first terminal connected with the control terminal of the driving switch, the second terminal connected with second terminal of the driving switch; control terminal of the third controllable switch connected with a third scanning line, first terminal connected with the second terminal of the driving switch; anode of an OLED connected with the second terminal of the third controllable switch, cathode is grounded to avoid unstable current of the OLED by drift of threshold voltage of driving transistor.

8 Claims, 3 Drawing Sheets

(56) References Cited

U.S. PATENT DOCUMENTS

| | | | | |
|---|---|---|---|---|
| 2006/0043366 | A1 | 3/2006 | Min et al. | |
| 2009/0201231 | A1* | 8/2009 | Takahara | G09G 3/3233 345/76 |
| 2010/0265233 | A1* | 10/2010 | Omoto | G09G 3/3233 345/211 |
| 2012/0200611 | A1* | 8/2012 | Matsui | G09G 3/3233 345/690 |
| 2014/0070725 | A1 | 3/2014 | Jing et al. | |
| 2015/0109277 | A1 | 4/2015 | Tseng et al. | |
| 2015/0348464 | A1 | 12/2015 | Jung et al. | |
| 2015/0356919 | A1 | 12/2015 | Shanghai et al. | |
| 2016/0247449 | A1 | 8/2016 | Jingwen et al. | |
| 2016/0343298 | A1 | 11/2016 | Xu | |

* cited by examiner

PIXEL COMPENSATION CIRCUIT, METHOD AND FLAT DISPLAY DEVICE

BACKGROUND OF THE INVENTION

1. Field of the Invention

The present invention relates to a display technology field, and more particularly to a pixel compensation circuit, a method and a flat display device.

2. Description of Related Art

A current Organic Light Emitting diode (OLED) display has advantages of small size, simple structure, self-lighting, high brightness, wide viewing-angle, short response time, and so on, attracting widespread attention.

In the current organic light emitting diode display, a transistor is used as a driving transistor for controlling a current flowing through an organic light emitting diode OLED so that the importance of a threshold voltage of the driving transistor is very obvious. A positive drift or a negative drift of the threshold voltage will make different currents flowing through the organic light emitting diode under a same data signal. In a usage process of the transistor, factors of lighting in the oxide semiconductor or voltage stress of source and drain electrode may cause the threshold voltage to drift such that the current of the organic light emitting diode is unstable, and the display brightness of a panel is uneven.

SUMMARY OF THE INVENTION

The main technology problem solved by the present invention is to provide a pixel compensation circuit, a method and a flat display device in order to avoid an unstable current of the organic light emitting diode caused by the drift of the threshold voltage of the driving transistor to realize an even brightness display of the panel.

In order to solve above technology problems, a technology solution adopted by the present invention is: a pixel compensation circuit, comprising:

a first controllable switch, and the first controllable switch includes a control terminal, a first terminal and a second terminal; the control terminal of the first controllable switch is connected with a first scanning line, the first terminal of the first controllable switch is connected with a data line to receive a data voltage from the data line;

a storage capacitor, and the storage capacitor includes a first terminal and a second terminal; the first terminal of the storage capacitor is connected with the second terminal of the first controllable switch;

a driving switch, and the driving switch includes a control terminal, a first terminal and a second terminal; the control terminal of the driving switch is connected with the second terminal of the storage capacitor, and the first terminal of the driving switch is connected with a voltage terminal;

a second controllable switch, and the second controllable switch includes a control terminal, a first terminal and a second terminal; the control terminal of the second controllable switch is connected with a second scanning line, the first terminal of the second controllable switch is connected with the control terminal of the driving switch, and the second terminal of the second controllable switch is connected with the second terminal of the driving switch;

a third controllable switch, and the third controllable switch includes a control terminal, a first terminal and a second terminal; the control terminal of the third controllable switch is connected with a third scanning line, the first terminal of the third controllable switch is connected with the second terminal of the driving switch; and an organic light emitting diode, and the organic light emitting diode includes an anode and a cathode; the anode of the organic light emitting diode is connected with the second terminal of the third controllable switch, and the cathode of the organic light emitting diode is connected with a ground.

Wherein, the driving switch, the first controllable switch to the third controllable switch are all NMOS thin-film transistors, PMOS thin-film transistors or a combination of NMOS thin-film transistors and PMOS thin-film transistors; the control terminal, the first terminal and the second terminal of each of the driving switch, the first controllable switch to the third controllable switch are respectively corresponding to a gate electrode, a drain electrode and a source electrode of the thin-film transistor.

In order to solve above technology problems, another technology solution adopted by the present invention is: a pixel compensation method, comprising:

in a reset stage, a driving switch, a first to a third controllable switches are all turned on, voltages at two terminals of a storage capacitor are reset, a voltage Va at a first terminal of the storage capacitor is equal to a reference voltage Vref, a voltage Vb at a second terminal of the storage capacitor is equal to a sum of a voltage VDD outputted from a voltage terminal and a threshold voltage Vth of the driving switch;

in a sample stage, the driving switch, the first and the second controllable switches are all turned on, the third controllable switch is turned off, the third controllable switch is turned off, the storage capacitor is charged, the voltage Va at the first terminal of the storage capacitor is equal to a data voltage Vdata outputted from the data line, and the voltage Vb at the second terminal of the storage capacitor is equal to the sum of the voltage VDD outputted from the voltage terminal and the threshold voltage Vth of the driving switch;

in an obtaining stage, the driving switch is turned on, the first to the third controllable switches are all turned off, the voltages at the two terminals of the storage capacitor are maintained at the sample stage; and in a driving emitting stage, the second controllable switch is turned off, the driving switch, the first and the third controllable switches and are both turned on, the voltage Va at the first terminal of the storage capacitor is equal to the reference voltage Vref; because the coupling effect of the storage capacitor, the voltage Vb at the second terminal of the storage capacitor satisfies that $Vb=VDD+Vth+Vref-Vdata$, a voltage Vgs between the control terminal and the second terminal of the driving switch satisfies that $Vgs=Vb-VDD=Vref-Vdata+Vth$, accordingly, a current I flowing through the driving switch satisfies that $I=K(Vgs-Vth)^2=K(Vref-Vdata)^2$, wherein, K is a coefficient.

Wherein, the driving switch, the first controllable switch to the third controllable switch are all NMOS thin-film transistors, PMOS thin-film transistors or a combination of NMOS thin-film transistors and PMOS thin-film transistors; the control terminal, the first terminal and the second terminal of each of the driving switch, the first controllable switch to the third controllable switch are respectively corresponding to a gate electrode, a drain electrode and a source electrode of the thin-film transistor.

In order to solve above technology problems, another technology solution adopted by the present invention is: a flat display device, wherein, the flat display device includes a scanning driving circuit, the scanning driving circuit includes a pixel compensation circuit, and the pixel compensation circuit comprises:

a first controllable switch, and the first controllable switch includes a control terminal, a first terminal and a second terminal; the control terminal of the first controllable switch is connected with a first scanning line, the first terminal of the first controllable switch is connected with a data line to receive a data voltage from the data line;

a storage capacitor, and the storage capacitor includes a first terminal and a second terminal; the first terminal of the storage capacitor is connected with the second terminal of the first controllable switch;

a driving switch, and the driving switch includes a control terminal, a first terminal and a second terminal; the control terminal of the driving switch is connected with the second terminal of the storage capacitor, and the first terminal of the driving switch is connected with a voltage terminal;

a second controllable switch, and the second controllable switch includes a control terminal, a first terminal and a second terminal; the control terminal of the second controllable switch is connected with a second scanning line, the first terminal of the second controllable switch is connected with the control terminal of the driving switch, and the second terminal of the second controllable switch is connected with the second terminal of the driving switch;

a third controllable switch, and the third controllable switch includes a control terminal, a first terminal and a second terminal; the control terminal of the third controllable switch is connected with a third scanning line, the first terminal of the third controllable switch is connected with the second terminal of the driving switch; and an organic light emitting diode, and the organic light emitting diode includes an anode and a cathode; the anode of the organic light emitting diode is connected with the second terminal of the third controllable switch, and the cathode of the organic light emitting diode is connected with a ground.

Wherein, the driving switch, the first controllable switch to the third controllable switch are all NMOS thin-film transistors, PMOS thin-film transistors or a combination of NMOS thin-film transistors and PMOS thin-film transistors; the control terminal, the first terminal and the second terminal of each of the driving switch, the first controllable switch to the third controllable switch are respectively corresponding to a gate electrode, a drain electrode and a source electrode of the thin-film transistor.

Wherein, the flat display device according to claim 5, wherein the flat display device is an OLED or an LCD.

The beneficial effects of the present invention are: comparing with the prior art, the pixel compensation circuit and method of the present invention, through using multiple thin-film transistors as a driving transistor in order to avoid an unstable current of the organic light emitting diode caused by the drift of the threshold voltage of the driving transistor to realize an even brightness display of the panel.

DETAILED DESCRIPTION OF THE PREFERRED EMBODIMENT

Figure 1:
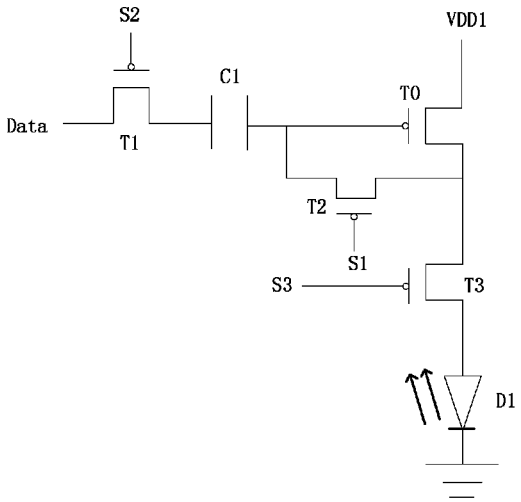
FIG. 1 is a schematic diagram of a pixel compensation circuit of the present invention.

With reference to FIG. 1, FIG. 1 is a schematic diagram of a pixel compensation circuit of the present invention. As shown in FIG. 1, the compensation circuit of the present invention includes a first controllable switch T1. The first controllable switch T1 includes a control terminal, a first terminal and a second terminal. The control terminal of the first controllable switch T1 is connected with a first scanning line S2, the first terminal of the first controllable switch T1 is connected with a data line Data to receive a data voltage Vdata from the data line Data.

A storage capacitor C1, the storage capacitor C1 includes a first terminal and a second terminal. The first terminal of the storage capacitor C1 is connected with the second terminal of the first controllable switch T1.

A driving switch T0, the driving switch T0 includes a control terminal, a first terminal and a second terminal. The control terminal of the driving switch T0 is connected with the second terminal of the storage capacitor C1, and the first terminal of the driving switch T0 is connected with a voltage terminal VDD1.

A second controllable switch T2, the second controllable switch T2 includes a control terminal, a first terminal and a second terminal. The control terminal of the second controllable switch T2 is connected with a second scanning line S1, the first terminal of the second controllable switch T2 is connected with the control terminal of the driving switch T0, and the second terminal of the second controllable switch T2 is connected with the second terminal of the driving switch T0.

A third controllable switch T3, the third controllable switch T3 includes a control terminal, a first terminal and a second terminal. The control terminal of the third controllable switch T3 is connected with a third scanning line S3, the first terminal of the third controllable switch T3 is connected with the second terminal of the driving switch T0; and an organic light emitting diode D1, the organic light emitting diode D1 includes an anode and a cathode. The anode of the organic light emitting diode D1 is connected with the second terminal of the third controllable switch T3, and the cathode of the organic light emitting diode is connected with a ground.

In the present embodiment, the driving switch T0, the first controllable switch T1 to the third controllable switch T3 are all NMOS thin-film transistors, PMOS thin-film transistors or a combination of NMOS thin-film transistors and PMOS thin-film transistors. The control terminal, the first terminal and the second terminal of each of the driving switch T0, the first controllable switch T1 to the third controllable switch T3 are respectively corresponding to a gate electrode, a drain electrode and a source electrode of the thin-film transistor.

Figure 2:
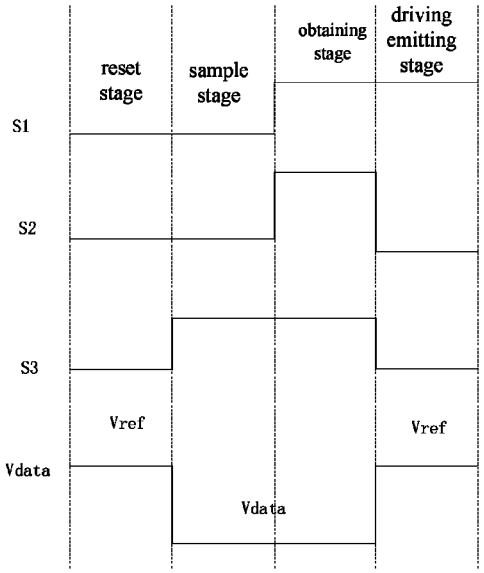
FIG. 2 is a waveform diagram of the pixel compensation circuit of the present invention.
Figure 3:
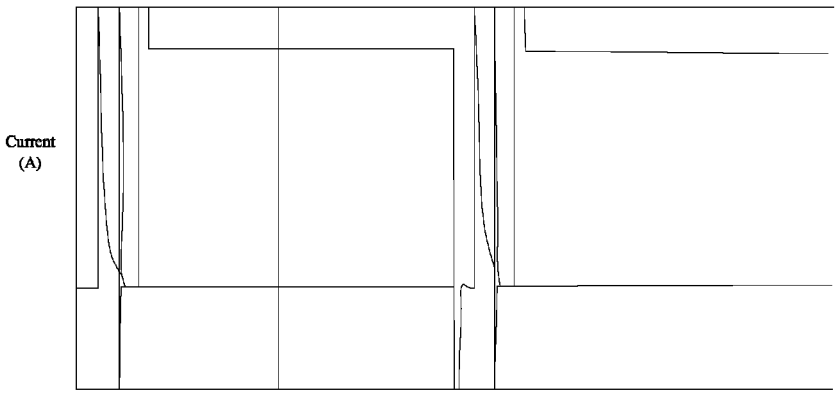
FIG. 3 is a simulation result diagram of the pixel compensation circuit of the present invention.

With reference to FIG. 2, and FIG. 2 is a waveform diagram of the pixel compensation circuit of the present invention. FIG. 3 is a simulation result diagram of the pixel compensation circuit of the present invention. According to FIG. 1 to FIG. 3, the operation principle (the pixel compensation method) of the pixel compensation circuit obtained from FIG. 1 to FIG. 3 is as following:

In a reset stage, the driving switch T0, the first to the third controllable switches T1-T3 are all turned on, voltages at two terminals of the storage capacitor C1 are reset, a voltage Va at the first terminal of the storage capacitor C1 is equal to a reference voltage Vref, a voltage Vb at the second terminal of the storage capacitor C1 is equal to a sum of a voltage VDD outputted from the voltage terminal VDD1 and a threshold voltage Vth of the driving switch T0;

in a sample stage, the driving switch T0, the first and the second controllable switches T1 and T2 are all turned on, the third controllable switch T3 is turned off, the third controllable switch T3 is turned off, the storage capacitor C1 is charged, the voltage Va at the first terminal of the storage capacitor C1 is equal to a data voltage Vdata outputted from the data line Data, and the voltage Vb at the second terminal of the storage capacitor C1 is equal to the sum of the voltage VDD outputted from the voltage terminal VDD1 and the threshold voltage Vth of the driving switch T0;

in an obtaining stage, the driving switch T0 is turned on, the first to the third controllable switches T1-T3 are all turned off, the voltages at the two terminals of the storage capacitor C1 are maintained at the sample stage;

in a driving emitting stage, the second controllable switch T2 is turned off, the driving switch T0, the first and the third controllable switches T1 and T3 are both turned on, the voltage Va at the first terminal of the storage capacitor C1 is equal to the reference voltage Vref. Because the coupling effect of the storage capacitor C1, the voltage Vb at the second terminal of the storage capacitor C1 satisfies a following relationship:

$$Vb=VDD+Vth+Vref-Vdata \quad \text{(formula 1);}$$

a voltage Vgs between the control terminal and the second terminal of the driving switch T0 satisfies a following relationship:

$$Vgs=Vb-VDD=Vref-Vdata+Vth \quad \text{(formula 2);}$$

accordingly, a current I flowing through the driving switch T0 satisfies a following relationship:

$$I=K(Vgs-Vth)^2=K(Vref-Vdata)^2 \quad \text{(formula 3);}$$

wherein, K is a coefficient and satisfies a following relationship:

$$K=\mu CoxW/(2*L) \quad \text{(formula 4);}$$

Wherein, μ is electron mobility, Cox is a capacitance of an insulation layer of a thin-film transistor of a unit area; L and W are respectively an effective channel and channel width length of the driving switch T0.

From the above formula 3 and formula 4 and combined with table 1 shown below, a current flowing through the organic light emitting diode D1 is unrelated to the threshold voltage Vth of the driving switch T0.

TABLE 1

| Vdata | Vfb = −0.25 V $I_{OLED}$ | Vfb = −0.75 V $I_{OLED}$ | % $\Delta I_{OLED}$ | Vfb = 0.25 V $I_{OLED}$ | % $\Delta I_{OLED}$ |
|---|---|---|---|---|---|
| V1 | 1.18484E−06 | 1.18281E−06 | −0.17133115 | 1.17828E−06 | −0.553661254 |
| V2 | 4.2343E−07 | 4.2176E−07 | −0.39439813 | 4.3158E−07 | 1.924757339 |
| V3 | 6.182E−08 | 6.128E−08 | −0.87350372 | 6.8279E−08 | 10.44807506 |
| V4 | 6.15E−09 | 6.46E−09 | 5.040650407 | 5.85E−09 | −4.87804878 |

Therefore, the pixel compensation circuit can avoid an unstable current of the light emitting diode caused by the drift of the threshold voltage Vth of the driving switch T0 in order to realize an even brightness display of the panel.

Figure 4:
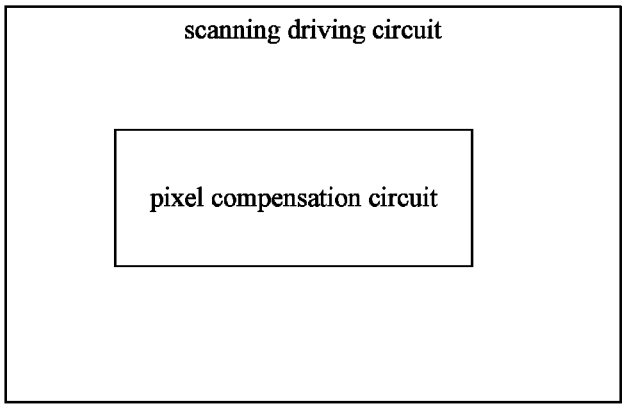
FIG. 4 is a schematic diagram of a scanning driving circuit of the present invention.

With reference to FIG. 4, and FIG. 4 is a schematic diagram of scanning driving circuit of the present invention. The scanning driving circuit includes a pixel compensation circuit to avoid an uneven brightness display of the panel generated by the drifting of the threshold voltage of the driving transistor in the scanning driving circuit.

Figure 5:
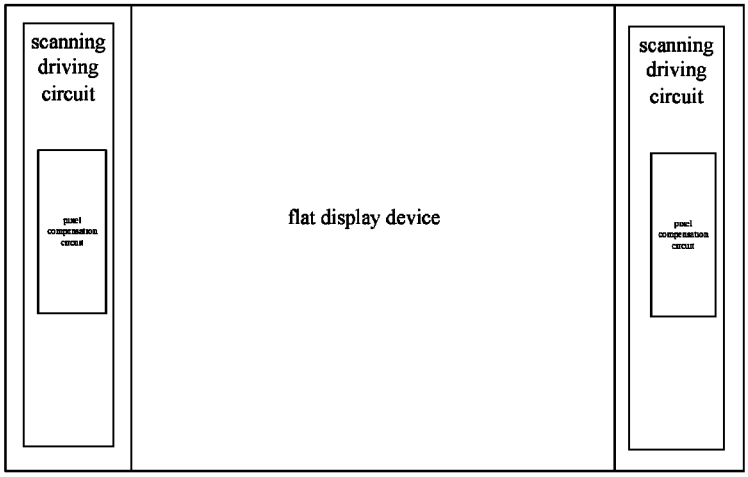
FIG. 5 is a schematic diagram of a flat display device of the present invention.

FIG. 5 is a schematic diagram of a flat display device of the present invention. The flat display device can be an OLED or an LCD. The flat display device includes the above scanning driving circuit and the pixel compensation circuit. The scanning driving circuit of the pixel compensation circuit is disposed at the periphery of the flat display device such as disposing at two terminals of the flat display device.

The pixel compensation circuit and method, through using multiple thin-film transistors as a driving transistor in order to avoid an unstable current of the organic light emitting diode caused by the drift of the threshold voltage of the driving transistor to realize an even brightness display of the panel.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A pixel compensation method, comprising:

in a reset stage, a driving switch, a first to a third controllable switches being all turned on, voltages at two terminals of a storage capacitor being reset, a voltage Va at a first terminal of the storage capacitor being equal to a reference voltage Vref, a voltage Vb at a second terminal of the storage capacitor being equal to a sum of a voltage VDD outputted from a voltage terminal and a threshold voltage Vth of the driving switch;

in a sample stage, the driving switch, the first and the second controllable switches being all turned on, the third controllable switch being turned off, the third controllable switch being turned off, the storage capacitor being charged, the voltage Va at the first terminal of the storage capacitor being equal to a data voltage Vdata outputted from the data line, and the voltage Vb at the second terminal of the storage capacitor being equal to the sum of the voltage VDD outputted from the voltage terminal and the threshold voltage Vth of the driving switch;

in an obtaining stage, the driving switch being turned on, the first to the third controllable switches being all turned off, the voltages at the two terminals of the storage capacitor being maintained at the sample stage; and in a driving emitting stage, the second controllable switch being turned off, the driving switch, the first and the third controllable switches and being both turned on, the voltage Va at the first terminal of the storage capacitor being equal to the reference voltage Vref, because the coupling effect of the storage capacitor, the voltage Vb at the second terminal of the storage capacitor satisfying that Vb=VDD+Vth+Vref−Vdata, a voltage Vgs between the control terminal and the second terminal of the driving switch satisfying that Vgs=Vb−VDD=Vref−Vdata+Vth, accordingly, a current I flowing through the driving switch satisfying that $I=K(Vgs-Vth)^2=K(Vref-Vdata)^2$,wherein, K is a coefficient.

2. The pixel compensation method according to claim 1, wherein the driving switch, the first controllable switch to the third controllable switch are all NMOS thin-film transistors, PMOS thin-film transistors or a combination of NMOS thin-film transistors and PMOS thin-film transistors, the control terminal, the first terminal and the second terminal of each of the driving switch, the first controllable switch to the third controllable switch are respectively corresponding to a gate electrode, a drain electrode and a source electrode of the thin-film transistor.

3. A flat display device, wherein the flat display device includes a scanning driving circuit, the scanning driving circuit includes a pixel compensation circuit, and the pixel compensation circuit comprises:

a first controllable switch, and the first controllable switch including a control terminal, a first terminal and a second terminal, the control terminal of the first controllable switch being connected with a first scanning line, the first terminal of the first controllable switch being connected with a data line to receive a data voltage from the data line;

a storage capacitor, and the storage capacitor including a first terminal and a second terminal, the first terminal of the storage capacitor being connected with the second terminal of the first controllable switch;

a driving switch, and the driving switch including a control terminal, a first terminal and a second terminal, the control terminal of the driving switch being connected with the second terminal of the storage capacitor, and the first terminal of the driving switch being connected with a voltage terminal;

a second controllable switch, and the second controllable switch including a control terminal, a first terminal and a second terminal, the control terminal of the second controllable switch being connected with a second scanning line, the first terminal of the second controllable switch being connected with the control terminal of the driving switch, and the second terminal of the second controllable switch being connected with the second terminal of the driving switch;

a third controllable switch, and the third controllable switch including a control terminal, a first terminal and a second terminal, the control terminal of the third controllable switch being connected with a third scanning line, the first terminal of the third controllable switch being connected with the second terminal of the driving switch; and an organic light emitting diode, and the organic light emitting diode including an anode and a cathode, the anode of the organic light emitting diode being connected with the second terminal of the third controllable switch, and the cathode of the organic light emitting diode being connected with a ground; and wherein in a reset stage, the driving switch, the first to the third controllable switches are all turned on, and voltages at two terminals of a storage capacitor are reset, a voltage Va at a first terminal of the storage capacitor is equal to a reference voltage Vref, a voltage Vb at a second terminal of the storage capacitor is equal to a sum of a voltage VDD outputted from a voltage terminal and a threshold voltage Vth of the driving switch.

4. The flat display device according to claim 3, wherein the driving switch, the first controllable switch to the third controllable switch are all NMOS thin-film transistors, PMOS thin-film transistors or a combination of NMOS thin-film transistors and PMOS thin-film transistors, the control terminal, the first terminal and the second terminal of each of the driving switch, the first controllable switch to the third controllable switch are respectively corresponding to a gate electrode, a drain electrode and a source electrode of the thin-film transistor.

5. The flat display device according to claim 3, wherein, the flat display device according to claim 3, wherein the flat display device is an OLED or an LCD.

6. The flat display device according to claim 3, wherein in a sample stage, the driving switch, the first and the second controllable switches are all turned on, the third controllable switch is turned off, the third controllable switch is turned off, the storage capacitor is charged, the voltage Va at the first terminal of the storage capacitor is equal to a data voltage Vdata outputted from the data line, and the voltage Vb at the second terminal of the storage capacitor is equal to the sum of the voltage VDD outputted from the voltage terminal and the threshold voltage Vth of the driving switch.

7. The flat display device according to claim 3, wherein in an obtaining stage, the driving switch is turned on, the first to the third controllable switches are all turned off, the voltages at the two terminals of the storage capacitor are maintained at the sample stage.

8. The flat display device according to claim 3, wherein in a driving emitting stage, the second controllable switch is turned off, the driving switch, the first and the third controllable switches and are both turned on, the voltage Va at the first terminal of the storage capacitor is equal to the reference voltage Vref, because the coupling effect of the storage capacitor, the voltage Vb at the second terminal of the storage capacitor satisfies that Vb=VDD+Vth+Vref−Vdata, a voltage Vgs between the control terminal and the second terminal of the driving switch satisfies that Vgs=Vb−VDD=Vref−Vdata+Vth, accordingly, a current I flowing through the driving switch satisfies that $I=K(Vgs-Vth)^2=K(Vref-Vdata)^2$,wherein, K is a coefficient.

* * * * *